US010669075B2

(12) United States Patent
Robles González et al.

(10) Patent No.: US 10,669,075 B2
(45) Date of Patent: Jun. 2, 2020

(54) COVER CAP WITH FITTED GASKET DESIGNED FOR SEALING A METALLIC BOTTLE

(71) Applicant: Crown Packaging Technology, Inc., Alsip, IL (US)

(72) Inventors: Gilberto Robles González, Nuevo Leon (MX); Romualdo Segura Ruiz, Nuevo León (MX); Eric Gerardo Rodríguez Balbuena, Nuevo León (MX); Ana Karen Meléndez Rivera, Nuevo León (MX)

(73) Assignee: Crown Packaging Technology, Inc., Alsip, IL (US)

( * ) Notice: Subject to any disclaimer, the term of this patent is extended or adjusted under 35 U.S.C. 154(b) by 87 days.

(21) Appl. No.: 15/738,661

(22) PCT Filed: Jun. 30, 2016

(86) PCT No.: PCT/MX2016/000067

§ 371 (c)(1),
(2) Date: Jun. 12, 2018

(87) PCT Pub. No.: WO2017/007297

PCT Pub. Date: Jan. 12, 2017

(65) Prior Publication Data

US 2018/0282027 A1 Oct. 4, 2018

(30) Foreign Application Priority Data

Jul. 3, 2015 (MX) ..... MX/a/2015/008677

(51) Int. Cl.

| | |
|---|---|
| ***B65D 41/04*** | (2006.01) |
| ***B65D 41/32*** | (2006.01) |
| ***B65D 41/34*** | (2006.01) |

(52) U.S. Cl.

CPC ..... *B65D 41/325* (2013.01); *B65D 41/045* (2013.01); *B65D 41/348* (2013.01); *B65D 41/3428* (2013.01)

(58) Field of Classification Search

CPC .. B65D 41/325; B65D 41/348; B65D 41/045; B65D 41/3428

(Continued)

(56) References Cited

U.S. PATENT DOCUMENTS

| | | | |
|---|---|---|---|
| 2,158,683 | A | 5/1939 | White |
| 3,348,718 | A | 10/1967 | Musy |

(Continued)

FOREIGN PATENT DOCUMENTS

| | | | |
|---|---|---|---|
| CA | 1051376 | A | 3/1979 |
| CN | 103359377 | A | 10/2013 |

(Continued)

*Primary Examiner* — James N Smalley

(74) *Attorney, Agent, or Firm* — BakerHostetler

(57) ABSTRACT

Disclosed is a metallic cover cap for sealing a metallic bottle, comprising a gasket provided with a flat central zone and an annular zone which includes an outer rim and an inner rim that are separated by a notch, such that the outer rim extends axially, continues circumferentially, and includes: a first surface; a second surface with a flat portion and a concave portion radially opposite the notch; and a third flat surface that extends between the first and second surfaces, and the inner rim extends axially, continues circumferentially and spaced radially inwards of the first rim, and includes: a first flat surface opposite and perpendicular to the flat zone; a second concave surface radially opposite the notch; and a third flat surface between the first and second surfaces that is inclined toward the notch.

20 Claims, 4 Drawing Sheets

(58) Field of Classification Search
USPC ..... 215/341, 343, 349–351
See application file for complete search history.

(56) References Cited

U.S. PATENT DOCUMENTS

| | | | | |
|---|---|---|---|---|
| 3,503,534 | A | 3/1970 | Moller | |
| 3,583,591 | A | 6/1971 | Kouichi | |
| 3,887,100 | A | 6/1975 | Coven et al. | |
| 4,114,775 | A * | 9/1978 | Shinozaki | B65D 41/0464 206/807 |
| 4,165,009 | A | 8/1979 | Murayama | |
| 4,415,096 | A | 11/1983 | Ohmi | |
| 4,463,863 | A * | 8/1984 | Imagawa | B65D 53/04 215/343 |
| 4,632,265 | A | 12/1986 | Cochrane | |
| 2006/0169665 | A1 * | 8/2006 | Matukawa | B65D 41/3428 215/252 |
| 2008/0073309 | A1 * | 3/2008 | Nakajima | B65D 41/045 215/252 |
| 2009/0101661 | A1 * | 4/2009 | Awane | B65D 7/045 220/620 |

FOREIGN PATENT DOCUMENTS

| | | | | |
|---|---|---|---|---|
| CN | 106428973 | A | 2/2017 | |
| EP | 0039196 | A1 | 11/1981 | |
| EP | 0931728 | A1 | 7/1999 | |
| EP | 1181210 | A1 | 2/2002 | |
| ES | 2282513 | T3 | 10/2007 | |
| FR | 223055 | A2 | 12/1974 | |
| FR | 2449611 | A1 | 9/1980 | |
| FR | 2779702 | A1 | 12/1999 | |
| GB | 521860 | A | 6/1940 | |
| GB | 605292 | A | 7/1948 | |
| GB | 1277274 | A | 6/1972 | |
| GB | 1552713 | A | 9/1979 | |
| JP | 2001-139053 | A | 5/2001 | |
| JP | 2006151405 | A * | 6/2006 | B65D 53/04 |
| JP | 4683603 | B2 | 5/2011 | |
| KR | 101020030 | B1 | 3/2011 | |
| TW | 204324 | B | 4/1993 | |
| WO | WO 00/69742 | A1 | 11/2000 | |
| WO | WO 03/047991 | A1 | 6/2003 | |
| WO | WO 2010/036416 | A1 | 4/2010 | |
| WO | WO 2013/052219 | A1 | 4/2013 | |

* cited by examiner

COVER CAP WITH FITTED GASKET DESIGNED FOR SEALING A METALLIC BOTTLE

CROSS-REFERENCE TO RELATED APPLICATIONS

This application is the National Stage of International Application No. PCT/MX2016/000067, filed Jun. 30, 2016, which claims the benefit of Mexican application number MX/a/2015/008677, filed Jul. 3, 2015, the disclosures of which are incorporated herein by reference in their entirety.

TECHNICAL FIELD OF THE INVENTION

The present invention relates to cover-type metallic caps for sealing bottles; in particular, it refers to a cover cap with fitted gasket designed for sealing a threaded opening of a metallic bottle.

BACKGROUND OF THE INVENTION

At present, cover-type metallic caps are formed by a laminated piece with a circular inner- and outer-face layout, from whose edge a peripheral skirt extends in a descending manner and to which a safety ring is attached by a series of bridges, and a gasket attached to the inner face of the circular layout and provided with a flat central zone and an annular zone, including an outer rim and an inner rim separated by a notch. These metallic cover caps are used to seal a threaded opening of a glass bottle containing a beverage, whether pressurized or not, since the thread that is formed on the skirt of the cover cap serves to engage with the outer thread of the opening of the glass bottle, while the safety ring attached to the skirt is an indicator of improper tampering with the bottle.

When the metallic cover cap is placed on the threaded opening of the glass bottle, the skirt and the safety ring are formed by means of a rolling process, in such a way that the skirt acquires a threading that interengages with the outer thread of the opening of the glass bottle, while the safety ring is deformed inwardly by gripping the lower surface of the gripping ring of the opening of the glass bottle, allowing a splice coupling between the sealing surface of the opening of the glass bottle and the gasket. More particularly, the sealing surface of the opening of the glass bottle is housed in the notch of the annular zone of the gasket; at this point, the outer edge of the sealing surface of the opening of the glass bottle engages the inner surface of the outer rim of the annular zone of the gasket, while the inner edge of the sealing surface of the mouth of the glass bottle engages with the inner surface from the inner rim of the annular zone of the gasket, thus ensuring a lateral seal on both sides of the notch, so that the plastic material of the gasket is deformed by the pressure exerted inside the glass bottle. The engagement of the notch and of the outer and inner rims over the sealing surface of the mouth of the glass bottle prevents the beverage contained within the glass bottle from escaping.

The current metallic cover cap that is used to seal the mouth of a glass bottle is not fit for sealing a mouth of a metal bottle, because the mouth of a metallic bottle has a different configuration to the configuration of a mouth of a glass bottle, as observed in FIGS. 1, 2, and 3. The opening 10 of a glass bottle has a sealing surface 11 with an outer diameter D1 and an inner diameter D2, an outer thread 12, and a gripping ring 15. The sealing surface 11 has an outer edge 13 and an inner edge 14 where the outer rim and the inner rim of the annular region of the metallic cover cap are respectively seated by the proper obstruction and sealing of the mouth once the metallic cover cap is screwed on.

In contrast therewith, the threaded opening 20 of a metallic bottle has a contoured sealing surface 21 with an outer diameter D1 and an inner diameter D2, an outer thread 22, and a gripping ring 25. The sealing surface 21 has an outer edge 23 and an inner edge 24. The outer diameter D3 is generally equal to the inner diameter D1 of the sealing surface 11 of the glass bottle 10, while the inner diameter D4 is greater than the outer diameter D2 of the sealing surface 11 of the glass bottle 10.

In addition to the above, by reason of its manufacturing process, the threaded mouth of the glass bottle has a constant diameter and its material has a resistance that does not allow deformation of the mouth during storage, transportation, filling, and sealing of the glass bottle, which favors the proper seating and airtight closing of the metallic crown-type cap. The configuration of the mouth of the glass bottle is standardized by the "Glass Packaging Institute." In contrast, the threaded mouth of the metallic bottle, in particular the sealing surface, tends to deform in its own manufacturing process, as well as in the storage, transportation, filling, and sealing of the metallic bottle. This implies that the diameter of the threaded mouth of the metallic bottle has variations or irregularities that can cause a non-airtight closing of the traditional metallic crown-type cap.

It is therefore, that the metallic cover cap currently used to seal glass bottles is not at all suitable for sealing metal bottles, as the current cover cap gasket is not fit to compensate for the variations present in the finish and the diameter of the sealing surface of the threaded mouth of the metal bottle; so, providing a metallic cover cap with a gasket whose design compensates for said imperfections in the threaded mouth of the metal bottle is required.

SUMMARY OF THE INVENTION

In view of what has been described above and with the purpose of solving the limitations found in metallic crown-type caps, the object of the invention is to offer a metallic cover cap for sealing a metallic bottle, the cover cap being formed by a laminated piece with a circular inner- and outer-face layout, from whose edge a peripheral skirt extends in a descending manner and to which a safety ring is attached by a series of bridges, and a gasket attached to the inner face of the circular layout and provided with a flat central zone and an annular zone, including an outer rim and an inner rim separated by a notch, such that the outer rim extends axially and circumferentially continuous and adjacent to the skirt and includes a first flat surface adjacent to the skirt, a second surface with a flat portion and a concave portion facing radially toward the notch, and a third flat surface that extends between the first and second surfaces; the inner rim extends axially and circumferentially continuous and spaced radially inward from the first rim and includes a first flat surface facing and perpendicular to the flat central zone, a second concave surface radially facing the notch, and a third flat surface inclined toward the notch between the first and second surfaces; and wherein the inner rim has a base of greater thickness than the thickness of the base of the outer rim.

Another object of the present invention is a metallic cover cap in use in combination with a metallic bottle with an opening with an outer thread, a sealing surface and a gripping ring, the cover cap being formed by a laminated piece with a circular inner- and outer-face layout, from whose edge a peripheral skirt extends in a descending manner with an inner thread interengaged to the outer thread of the opening of the metallic bottle, a safety ring attached to the skirt by a series of bridges and grasped to the gripping ring of the opening of the metallic bottle, and a gasket attached to the inner face of the circular layout and coupled to the sealing surface of the opening of the metallic bottle, the gasket being provided with a flat central zone and an annular zone including an outer rim and an inner rim separated by a notch, such that the outer rim extends axially and circumferentially continuous and adjacent to the skirt and includes a first flat surface adjacent to the skirt, a second surface with a flat portion and a concave portion facing radially toward the notch, and a third flat surface that extends between the first and second surfaces; the inner rim extends axially and circumferentially continuous and spaced radially inwardly from the first rim and includes a first flat surface facing and perpendicular to the flat central zone, a second concave surface radially facing the notch, and a third flat surface inclined toward the notch between the first and second surfaces; and wherein the inner rim has a base of greater thickness than the thickness of the base of the outer rim.

Finally, it is also an object of the present invention to offer a method for producing a metallic cover cap for sealing a metallic bottle, the method having the following steps: (a) providing a laminated piece with a circular inner- and outer-faced layout, from whose edge a peripheral skirt extends in a descending manner and to which a safety ring is attached by a series of bridges, and (b) molding by in situ pressing on the inner face of the circular layout a droplet of plastic material to configure a gasket provided with a flat central zone and an annular zone, including an outer rim and an inner rim separated by a notch, wherein the outer rim extends axially and circumferentially continuous and adjacent to the skirt and includes a first flat surface adjacent to the skirt, a second surface with a flat portion and a concave portion facing radially toward the notch, and a third flat surface that extends between the first and second surfaces; the inner rim extends axially and circumferentially continuous and spaced radially inwardly from the outer rim and includes a first flat surface facing and perpendicular to the flat central zone, a second concave surface radially facing the notch, and a third flat surface inclined toward the notch between the first and second surfaces; and wherein the inner rim has a base of greater thickness than the thickness of the base of the outer rim.

BRIEF DESCRIPTION OF THE FIGURES

The characteristic features of the invention are described in the following paragraphs in conjunction with the figures that accompany it, which have the purpose of defining the invention but without limiting the scope thereof.

DETAILED DESCRIPTION OF THE INVENTION

The present invention relates to a metallic cover cap for sealing a threaded opening of a metallic bottle, this metallic bottle being made of aluminum or any other metal fit for containing a pressurized or unpressurized beverage.

The descriptions and indications of the directions such as "downward" are taken as reference to the vertical orientation of the metallic bottle and cover cap illustrated in the figures.

Figure 1:
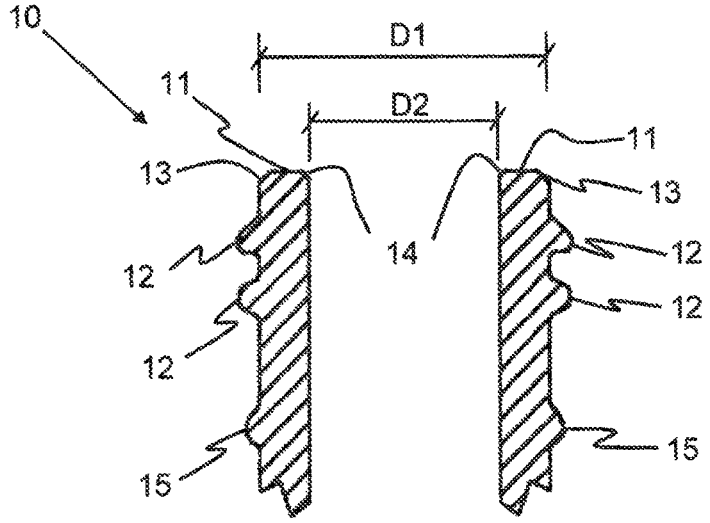
FIG. 1 shows a side view in section of a threaded opening of a glass bottle of the state of the art.
Figure 2:
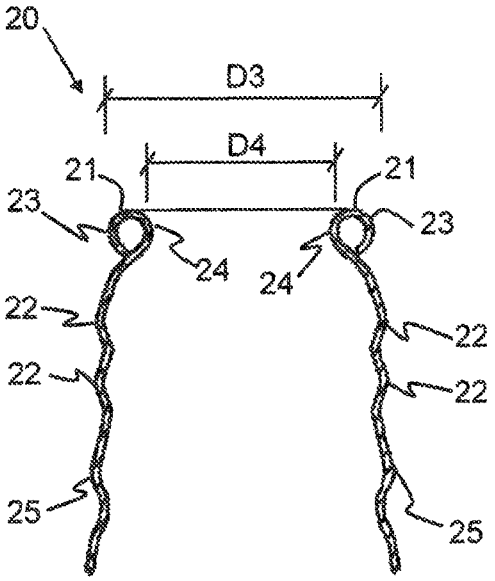
FIG. 2 shows a side sectional view of a first embodiment of a sealing surface bent inside a threaded opening of a metallic bottle of the state of the art.
Figure 3:
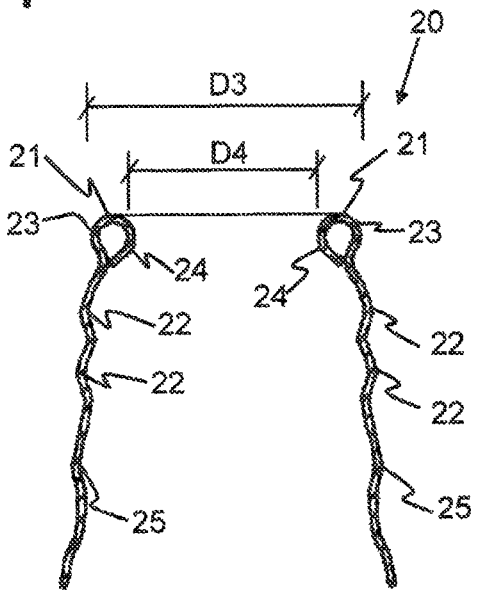
FIG. 3 shows a side sectional view of a first embodiment of a sealing surface bent on the outside of a threaded opening of a metallic bottle of the state of the art.
Figure 4:
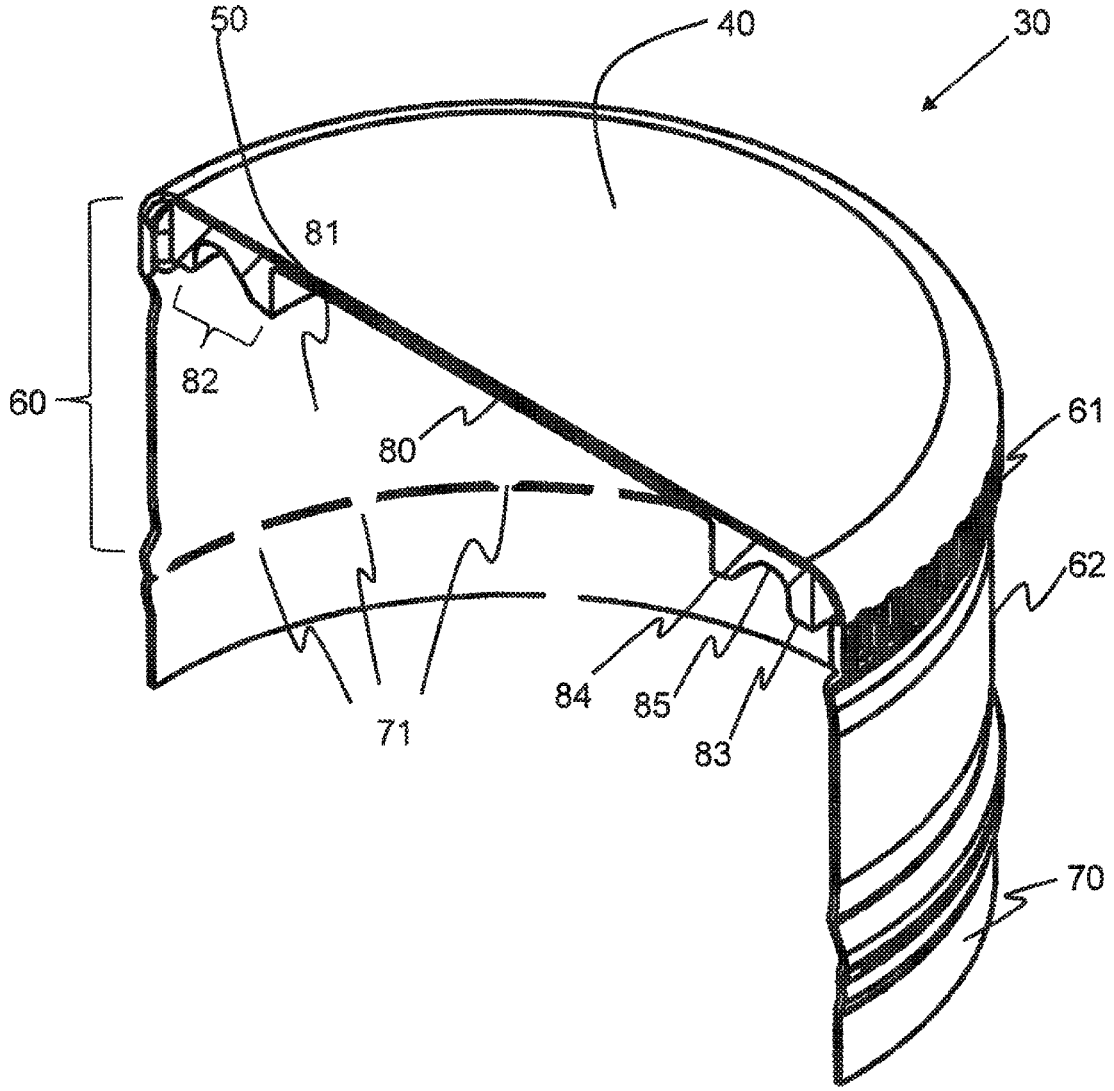
FIG. 4 shows a longitudinal cross-section view of a metallic cover cap according to the invention.

Reference is made to FIG. 4, which shows a longitudinal cross-section view of a metallic cover cap according to the invention. The metallic cover cap 30 is shown in its pre-closing condition to seal a threaded opening of a metallic bottle. The metallic cover cap 30 is formed by a laminated piece with a circular layout with an outer 40 and an inner face 50, provided with a peripheral skirt 60, a safety ring 70, and a gasket 80.

The metallic cover cap 30 of the invention is made from metallic sheets, preferably steel or aluminum, having a thickness ranging from approximately 0.160 mm to approximately 0.251 mm.

The outer face 40 is optionally covered with a pigmented or non-pigmented coating and on which the advertising is printed by means of lithography, for example, the brand of beverage or the bottler. In an alternative embodiment, the inner face 50 could be covered with a pigmented or non-pigmented coating that could give the metallic cover cap 30 a distinctive character that allows this face to be distinguished and/or be identified at a glance from this perspective versus other metallic cover caps, either during its manufacture, storage, distribution, marketing once such cover has been discarded.

The peripheral skirt 60 has a knurled band 61, a labile section 62, and alternatively a second knurled band (not shown). The knurled band 61 allows a better manual grip of the metallic cover cap 30 so that it can be more easily unscrewed from the metallic bottle once in place. The labile section 62 is the section that will take a threaded shape by means of a rolling process at the moment when the metallic cover cap 30 is placed on the threaded opening of the metallic bottle.

A safety ring 70, also known as tamper-proof or tamper-evident ring, is attached to the peripheral skirt 60 by a series of bridges 71 which act as a frangible means. The lower edge of the safety ring 70 is collapsible by rolling inwardly to engage and secure the retaining cord of the threaded opening of the metallic bottle once the metallic cover cap 30 is placed over the threaded opening of the metallic bottle, so that when the metallic cover cap 30 is unscrewed from the metallic bottle, then the bridges 71 fracture, causing separation of the safety ring 70 from the skirt 60, thereby indicating that the metallic bottle has been unduly opened or tampered with.

The gasket 80 has a circular layout and is positioned on the inner face 50, either in an adhered manner or formed on the metallic substrate or on the pigmented or non-pigmented coating placed on the inner face 50. The gasket 80 is provided with a flat central zone 81 and an annular zone 82 which includes an outer rim 83 and an inner rim 84 separated by a notch 85.

The notch 85 has a depth of 1.097 mm by 1.562 mm, the flat central zone 81 has a thickness of 0.198 mm to 0.282 mm.

The gasket 80 is made of a thermoformable material, either PVC, free of PVC, or any other substitute material of PVC and requires a thermoformable material droplet weight of 0.350 grams to 0.440 grams for its elaboration. This droplet weight quantity is much lower compared to the droplet weight of thermoformable material required to make the gaskets of the metallic cover caps of the state of the art, hovering around 0.530 grams. This smaller quantity of droplet weight makes it possible to obtain a gasket 80 with a lower thickness in the flat central zone 81 and the annular zone 82, and therefore smaller dimensions in its different elements can be achieved as described below. With this, the metallic cover cap 30 of the present invention, when being placed in use on a threaded opening of a metallic bottle (see FIG. 6) is further lowered on the threaded opening to such an extent that the safety ring 70 has a greater contact area with the gripping ring of the threaded opening of the metallic bottle and thus giving rise to a better grip and sealing in comparison with the metallic cover caps of the state of the art.

The gasket 80 has an inner diameter of approximately 17.5 mm to approximately 18.5 mm measured at the inner edge of the annular zone 82 and an outer diameter of approximately 25 mm to approximately 26.5 mm, measured at the outer edge of the annular zone 82.

Figure 5:
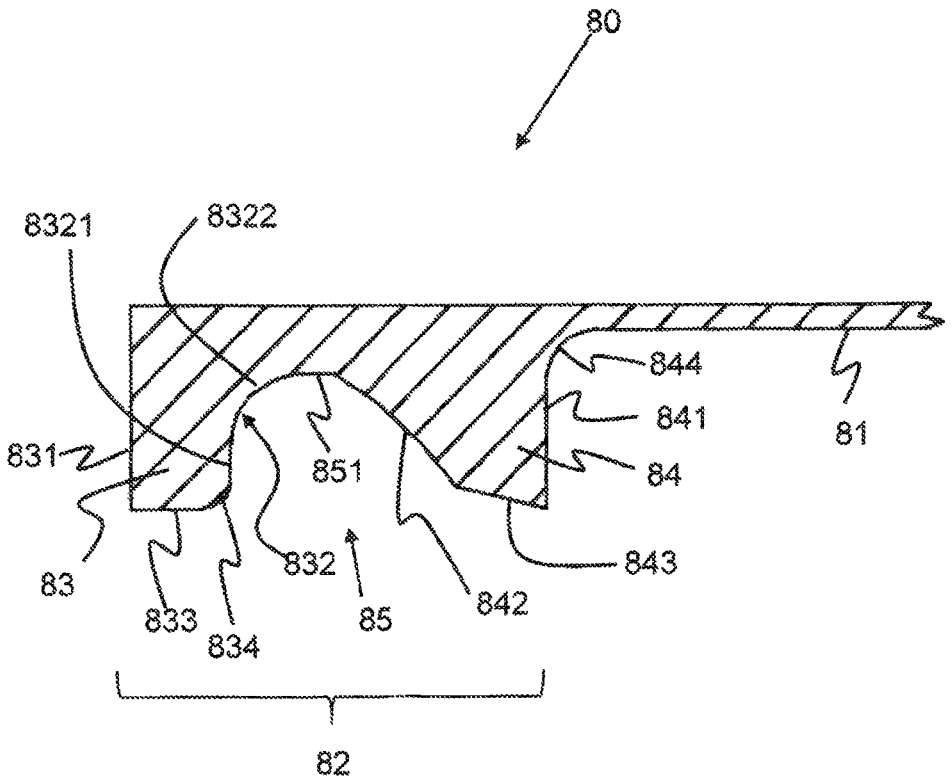
FIG. 5 shows a sectional view of one embodiment of the gasket of the metallic cover cap according to the invention.

Now, with reference to FIG. 5, a sectional view of one embodiment of the gasket of the metallic cover cap type according to the invention is shown. The gasket 80 that is provided with the flat central zone 81 and the annular zone 82 which in turn has the outer rim 83 and the inner rim 84 separated by the notch 85 are adapted to seal the sealing surface of the threaded opening of the metallic bottle.

The outer rim 83 extends axially and circumferentially continuous and adjacent to the skirt (not shown) and includes a first flat surface 831 adjacent to the skirt (not shown), a second surface 832 with a flat portion 8321 and a concave portion 8322 facing radially toward the notch 85, and a third flat surface 833 extending between the first flat surface 831 and the second surface 832.

The first flat surface 831 of the outer rim 83 has a height of 1.65 mm to 2.35 mm. The concave portion 8322 of the second surface 832 of the outer rim 83 has a radius of 0.589 mm to 0.838 mm. The third flat surface 833 measures from 0.80 mm to 1.139 mm.

Alternatively, the second surface 832 and third flat surface 833 of the outer rim 83 are attached by a convex surface 834 facing radially toward the notch 85. The convex surface 834 has a radius of 0.247 mm to 0.352 mm.

The inner rim 84 extends axially and circumferentially continuous and spaced radially inward from the outer rim 83 and includes a first flat surface 841 facing and perpendicular to the flat central zone 81, a second concave surface 842 facing radially toward the notch 85, and a third flat surface 843 inclined toward the notch 85 between the first flat surface 841 and the second concave surface 842.

The inner rim 84 has a base 843 of greater thickness than the thickness of the base 835 of the outer rim 83. The base 843 measures from 1.683 mm to 2.397 mm.

The first flat surface 841 of the inner rim 84 has a height of 1.15 mm to 1.85 mm. The second concave surface 842 of the inner rim 84 has a radius of 3.3 mm to 4.7 mm. The third flat surface 843 of the inner rim 84 has an angle of inclination of 9.9 degrees to 14.1 degrees and measures from 0.65 mm to 0.95 mm.

The first flat surface 841 of the inner rim 84 is attached to the flat central zone 81 by a concave surface 844 facing radially toward the flat central zone 81. The concave surface 844 has a radius of 1.965 degrees to 2.035 degrees.

Alternatively, the concave portion 8322 of the second surface 832 of the outer rim 83 is attached to the second concave surface 842 of the inner rim 84 by a flat surface 851, which represents the deepest part of the notch 85.

The metallic cover cap can be made in the following stages: first, the laminated piece of circular inner- 40 and outer-face 50 layout can be provided, from whose edge a peripheral skirt 60 extends in a descending manner and to which the safety ring 70 is attached by a series of bridges 71, and afterwards a droplet of plastic material is molded by in situ pressing on the inner face 40 of the circular layout to configure the gasket 80 provided with the flat central zone 81 and the annular zone 82, including an outer rim 83 and the inner rim 84 separated by a notch 85, wherein the outer rim 83 extends axially and circumferentially continuous and adjacent to the peripheral skirt 60 and includes the first flat surface 831 adjacent to the skirt 60, the second surface 832 with the flat portion 8321 and the concave portion 8322 facing radially toward the notch 85, and the third flat surface 833 that extends between the first flat surface 831 and the second surface 832; the inner rim 84 extends axially and circumferentially continuous and spaced radially inwardly from the outer rim 83 and includes the first flat surface 841 facing and perpendicular to the flat central zone 81, the second concave surface 842 radially facing the notch 85, and the third flat surface 843 inclined toward the notch 85, between the first flat surface 841 and the second concave surface 842; and wherein the inner rim 84 has the base 843 of greater thickness than the thickness of the base 835 of the outer rim 83.

Figure 6:
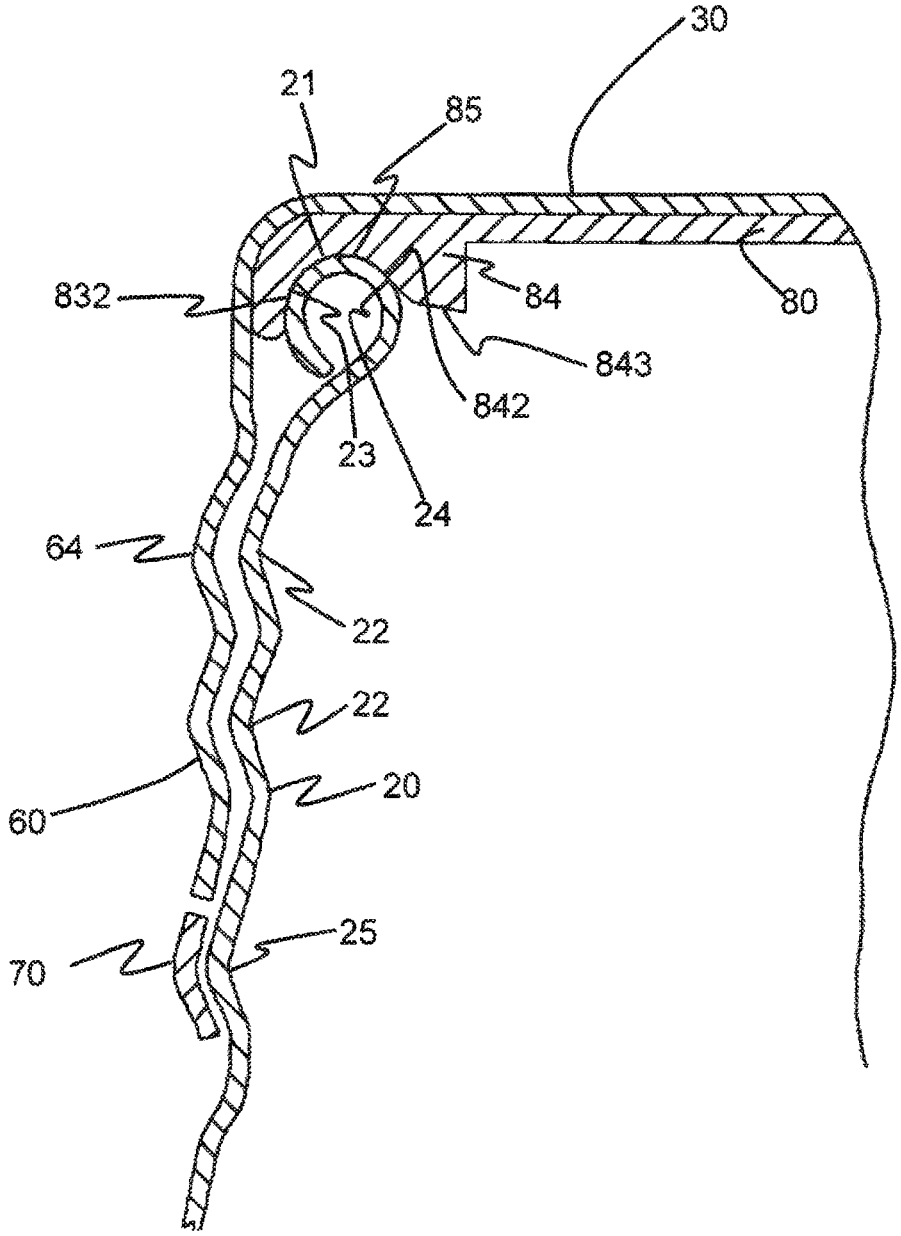
FIG. 6 shows a detail sectional view of the coupling of a metallic cover cap in use on a threaded opening of a metallic bottle according to the invention.

FIG. 6 illustrates a detail view in section of the coupling of a metallic cover cap in use on a threaded opening of a metallic bottle according to the invention. At the moment of placing the metallic cover cap 30 on the threaded opening 20 of the metallic bottle, the notch 85 of the gasket 80, in particular the second concave surface 842 of the inner rim 84 of the gasket 80, is seated on the inner edge 24 of the sealing surface 21 of the threaded opening 20 of the metallic bottle, which causes the metallic cover cap 30 to be automatically aligned concentrically to the threaded opening 20, thus compensating for any irregularity that the threaded opening 20 could have in its circular form. This concentric alignment of the metallic cover cap 30 is facilitated by the inclination of the third flat surface 843 and curvature by the second concave surface 842 of the inner rim 84 upon contacting the curvature of the inner edge 24 of the sealing surface 21 of the threaded opening 20 of the metal bottle.

Once the metallic cover cap 30 is placed on the threaded opening 20 of the metallic bottle, the peripheral skirt 60 and the safety ring 70 are worked by means of a rolling process, in such a way that the peripheral skirt 60 acquires a thread 64 that is interengaged with the outer thread 22 of the threaded opening 20 of the metallic bottle, while the safety ring 70 deforms inwardly by gripping the lower surface of the gripping ring 25 of the threaded opening 20 of the metallic bottle, which in turn allows a splice coupling between the sealing surface 21 of the threaded opening 20 and the gasket 80 of the metallic cover cap 30; in particular, the sealing surface 21 of the threaded opening 20 is housed in the notch 85 of the annular zone 82 of the gasket 80; at this point, the outer edge 23 of the sealing surface 21 engages with the second surface 832 of the outer rim 83 of the gasket 80, while the inner edge 24 of the sealing surface 21 of [sic] engages with the second concave surface 842 of the inner rim 84 of the gasket 80, ensuring a lateral seal on both sides of the notch 85, such that if the thermoformable material of the gasket 80 is deformed by the pressure exerted inside the metallic bottle, the engagement of the notch 85 to the contour of the sealing surface 21 of the threaded opening 20 of the metallic bottle prevents the beverage contained within the metal bottle from escaping.

When the metallic cover cap 30 is closed on the threaded opening 20 of the metallic bottle, the outer rim 83 of the gasket 80 undergoes a crush deformation between the outer edge 23 of the sealing surface 21 of the threaded opening 20 of the metallic bottle and the peripheral skirt 60 of the metallic cover cap 30, thereby allowing a grip between the metallic cover cap 30 and the threaded opening 20 of the metallic bottle; meanwhile, the second rim 24, because it contains a greater thickness and therefore a higher content of thermoformable material, remains in firm contact with the inner edge 24 of the sealing surface 21 of the threaded opening 20 of the metallic bottle; i.e., the second surface 832 of the outer rim 83 and the second concave surface 842 of the inner rim 84 of the gasket 80 are deformed in such a way that it adopts the curvature of the sealing surface 21 of the threaded opening 20, even with imperfections in it, thus tightly sealing the threaded opening 20 of the metallic bottle 20. This phenomenon of deformation and coupling to the contour of the sealing surface 21 of the threaded opening 20 of the metallic bottle is facilitated by the fact that the annular zone 82 of the gasket 80 has an asymmetrical transverse cross-section that favors its deformation by displacement of material toward the side, with less resistance and content of matter.

Based on the alternative embodiments described, it is contemplated that modifications to each of the described embodiments, as well as alternative application embodiments, will be considered obvious to a person skilled in the art of the technique under the present specification. It is therefore contemplated that the claims encompass said modifications and alternatives that are within the scope of the present invention.

Having described the invention as above, the content of the following claims is claimed as proprietary:

1. A metallic cover cap for sealing a metallic bottle, the cover cap being formed by a laminated piece with a circular inner- and outer-face layout, from whose edge a peripheral skirt extends in a descending manner and to which a safety ring is attached by a series of bridges, the cover cap comprising:

a gasket attached to the inner face of the circular layout and provided with a flat central zone and an annular zone, the annular zone including an outer rim and an inner rim separated by a notch;

the outer rim extending axially and circumferentially continuous and adjacent to the skirt and including a first flat surface adjacent to the skirt, a second surface with a flat portion and a concave portion facing radially toward the notch, and a third flat surface extending between the first and the second flat surfaces; and the inner rim extending axially and circumferentially continuous and spaced radially inward from the outer rim and including a first flat surface facing and perpendicular to the flat central zone, a second concave surface facing radially toward the notch, and a third flat surface inclined toward the notch between the first and the second surfaces; and wherein the inner rim has a base of greater thickness than the thickness of a base of the outer rim.

2. The metallic cover cap according to claim 1, wherein the first flat surface of the outer rim has a height of 1.65 mm to 2.35 mm.

3. The metallic cover cap according to claim 1, wherein the concave portion of the second surface of the outer rim has a radius of 0.589 mm to 0.838 mm.

4. The metallic cover cap according to claim 1, wherein the third flat surface of the outer rim measures from 0.80 mm to 1.139 mm.

5. The metallic cover cap according to claim 1, wherein the second surface and the third flat surface of the outer rim are joined by a convex surface facing radially toward the notch.

6. The metallic cover cap according to claim 5, wherein the convex surface has a radius of 0.247 mm to 0.352 mm.

7. The metallic cover cap according to claim 1, wherein the first flat surface of the inner rim has a height of 1.15 mm to 1.85 mm.

8. The metallic cover cap according to claim 1, wherein the second concave surface of the inner rim has a height of 3.3 mm to 4.7 mm.

9. The metallic cover cap according to claim 1, wherein the third flat surface of the inner rim has an angle of inclination of 9.9 degrees to 14.1 degrees.

10. The metallic cover cap according to claim 1, wherein the third flat surface of the inner rim measures from 0.65 mm to 0.95 mm.

11. The metallic cover cap according to claim 1, wherein the first flat surface of the inner rim is joined to the flat central zone by a concave surface facing radially toward the flat central zone.

12. The metallic cover cap according to claim 11, wherein the concave surface has a radius of 1.965 degrees to 2.035 degrees.

13. The metallic cover cap according to claim 1, wherein the notch has a depth of 1.097 mm to 1.562 mm.

14. The metallic cover cap according to claim 1, wherein the flat central zone has a thickness of 0.198 mm to 0.282 mm.

15. The metallic cover cap according to claim 1, wherein the gasket has a droplet weight of thermoformable material of 0.350 grams to 0.440 grams.

16. The metallic cover cap according to claim 1, wherein the gasket has an inner diameter of 17.5 mm to 18.5 mm measured at the inner edge of the annular zone and an outer diameter of 25 mm to 26.5 mm, measured at the outer edge of the annular zone.

17. The metallic cover cap according to claim 1, wherein the base of the inner rim of the annular zone measures from 1.683 mm to 2.397 mm.

18. The metallic cover cap according to claim 1, wherein the concave portion of the second surface of the outer rim is joined to the second concave surface of the inner rim by a flat surface.

19. A metallic cover cap in use in combination with a metallic bottle having an opening with an outer thread, a sealing surface, and a gripping ring, the metallic cover cap is formed by a laminated piece with a circular inner- and outer-face layout, from whose edge a peripheral skirt extends in a descending manner and to which a safety ring is attached by a series of bridges and attached to the gripping ring of the opening of the metallic bottle, the cover cap comprising:

a gasket attached to the inner face of the circular layout of the metallic cover cap and coupled to the sealing surface of the opening of the metallic bottle, the gasket being provided with a flat central zone and an annular zone that includes an outer rim and an inner rim separated by a notch;

the outer rim extending axially and circumferentially continuous and adjacent to the skirt and including a first flat surface adjacent to the skirt, a second surface with a flat portion and a concave portion facing radially toward the notch, and a third flat surface extending between the first and the second flat surfaces;

the inner rim extending axially and circumferentially continuous and spaced radially inward from the outer rim and including a first flat surface facing and perpendicular to the flat central zone, a second concave surface facing radially toward the notch, and a third flat surface inclined toward the notch between the first and the second surfaces; and wherein the inner rim has a base of greater thickness than the thickness of a base of the outer rim.

20. A method for making a metallic cover cap for sealing a metallic bottle, the method comprising the steps of:

(a) providing a laminated piece with a circular inner- and outer-face layout, from whose edge a peripheral skirt extends in a descending manner and to which a safety ring is attached by a series of bridges, and (b) molding, by in situ pressing on the inner face of the circular layout, a droplet of thermoformable material to configure a gasket provided with a flat central zone and an annular zone, including an outer rim and an inner rim separated by a notch, wherein the outer rim extends axially and circumferentially continuous and adjacent to the skirt and includes a first flat surface adjacent to the skirt, a second surface with a flat portion and a concave portion facing radially toward the notch, and a third flat surface that extends between the first and second surfaces; the inner rim extends axially and circumferentially continuous and spaced radially inwardly from the outer rim and includes a first flat surface facing and perpendicular to the flat central zone, a second concave surface radially facing the notch, and a third flat surface inclined toward the notch between the first and second surfaces; and wherein the inner rim has a base of greater thickness than the thickness of the base of the outer rim.

* * * * *